US005225392A

United States Patent [19]

Chang et al.

[11] Patent Number: 5,225,392

[45] Date of Patent: Jul. 6, 1993

[54] DUAL PROCESS THERMAL TRANSFER IMAGING

[75] Inventors: Jeffrey C. Chang, Ramsey; Andrew B. Becker, Woodbury, both of Minn.

[73] Assignee: Minnesota Mining and Manufacturing Company, St. Paul, Minn.

[21] Appl. No.: 870,600

[22] Filed: Apr. 20, 1992

[51] Int. Cl.[5] ..... B41M 5/035; B41M 5/38

[52] U.S. Cl. ..... 503/227; 428/195; 428/447; 428/500; 428/522; 428/913; 428/914

[58] Field of Search ..... 8/471; 428/195, 447, 428/500, 522, 913, 914; 503/227

[56] References Cited

U.S. PATENT DOCUMENTS

| | | | |
|---|---|---|---|
| 4,626,256 | 12/1986 | Kawasaki et al. | 8/471 |
| 4,707,411 | 11/1987 | Nakayama et al. | 428/413 |
| 4,820,687 | 4/1989 | Kawasaki et al. | 503/227 |
| 4,822,643 | 4/1989 | Chou et al. | 427/256 |
| 4,839,224 | 6/1989 | Chou et al. | 428/323 |
| 4,851,465 | 7/1989 | Yamakawa et al. | 524/431 |
| 4,853,365 | 8/1989 | Jongewaard et al. | 503/227 |
| 4,897,377 | 1/1990 | Marbrow | 503/227 |
| 4,900,631 | 2/1990 | Yamakawa et al. | 428/483 |
| 4,910,189 | 3/1990 | Hann | 503/227 |
| 4,914,078 | 4/1990 | Hann et al. | 503/227 |
| 4,927,666 | 5/1990 | Kawasaki et al. | 427/146 |
| 4,931,423 | 6/1990 | Uemura et al. | 503/227 |
| 4,985,321 | 1/1991 | Chou et al. | 430/38 |
| 4,990,485 | 2/1991 | Egashira et al. | 503/227 |
| 5,064,807 | 11/1991 | Yoshida et al. | 503/227 |

FOREIGN PATENT DOCUMENTS

| | | |
|---|---|---|
| 133011 | 7/1984 | European Pat. Off. . |
| 133012 | 7/1984 | European Pat. Off. . |
| 61-143176 | 6/1986 | Japan . |
| 63-178085 | 7/1988 | Japan . |
| 1-160681 | 6/1989 | Japan . |
| 2-29391 | 1/1990 | Japan . |
| 2-43092 | 2/1990 | Japan . |
| 2-95891 | 4/1990 | Japan . |
| 2-108591 | 4/1990 | Japan . |

*Primary Examiner*—B. Hamilton Hess

*Attorney, Agent, or Firm*—Gary L. Griswold; Walter N. Kirn; Gregory A. Evearitt

[57] ABSTRACT

A process for preparing an image utilizing both thermal dye and thermal mass transfer. A thermal transfer receptor element is utilized which contains a substrate and a vinyl chloride-containing copolymer which has a $T_g$ between about 50° and 85° C.; a weight average molecular weight between about 10,000 and 100,000 g/mol; a hydroxyl equivalent weight between 500 and 7,000 g/equiv.; a sulfonate equivalent weight between about 9,000 and about 23,000 g/equiv.; and an epoxy equivalent weight between about 500 and about 7,000 g/equiv., wherein a reactive amino-modified silicone has been chemically bonded to the vinyl chloride-containing copolymer.

11 Claims, No Drawings

DUAL PROCESS THERMAL TRANSFER IMAGING

FIELD OF THE INVENTION

This invention relates to an imaging process involving both thermal mass transfer and thermal dye transfer imaging.

BACKGROUND OF THE ART

Thermal dye transfer technology is known for its ability to provide an excellent, continuous-tone, full-color image. In thermal dye transfer printing, an image is formed on a receptor element by selectively transferring a dye to a receptor element from a dye donor element placed in momentary contact with the receptor element. It is a characteristic of the thermal dye transfer process (sometimes also referred to in the art as "sublimation transfer") that a dye diffuses without a carrier vehicle from the dye donor element directed by a thermal source, typically a thermal print head, which consists of small electrically heated elements. These elements transfer image-forming material from the dye donor element to areas of the dye receptor element in an image-wise manner.

Thermal dye transfer systems have advantages over other thermal transfer systems, such as chemical reaction systems and thermal mass transfer systems. In general, thermal dye transfer systems offer greater control of gray scale than these other systems, but they have problems as well. One problem is lack of release between the dye donor and receptor elements. This leads to unwanted mass transfer (e.g., blocking or sticking of the dye coat to receptor) during dye transfer. This problem has often been addressed by the addition of dye-permeable release coatings applied to the surface of the dye receptor layer. Additionally, materials are required for use in the receptor layer having suitable dye permeability, mordanting properties, adhesion to the substrate, and long term light and thermal stability.

Thermal mass transfer printing has also been employed in the art to provide thermal images. Although lacking continuous-tone imaging capability, thermal mass transfer is capable of generating a bright, dense, solid half-tone image. The term "thermal mass transfer" refers to thermal imaging processes in which a colorant is transferred from a donor element to the surface of a receptor element by action of a thermal source as described above, but without sublimation of the dye or colorant. Often the colorant is contained within a binder that is also transferred in the process, such as disclosed, for example, in U.S. Pat. Nos. 4,839,224 and 4,822,643. Also, the colorant may be present in a binderless construction as disclosed in U.S. Pat. No. 4,985,321. Thermal mass transfer processes may generally be carried out on colorants that do not exhibit measurable thermal diffusion in the image-receiving layer (e.g., pigments, metals, etc.), although colorants that do exhibit diffusion may be used. In contrast, pigments are not generally useful in the thermal dye diffusion process.

One drawback with thermal mass transfer has sometimes been the inability of the thermal mass transfer donor element to adequately adhere to the receiving layer, thereby leading to incomplete or no mass transfer of colorant into the receiving layer which is necessary to produce an adequate image. As a result, special receiving or receptor layers are required.

Polyvinyl chloride derivatives and copolymers have been used in thermal dye transfer receptor elements because of their advantageous properties. For example, U.S. Pat. No. 4,853,365 discloses that chlorinated polyvinyl chloride, used as a dye image receptor, has good dye solubility and high dye receptivity. Similarly, vinyl chloride/vinyl acetate copolymers have also been used in thermal dye transfer receptor elements as disclosed in Japanese Kokai Application Nos. 29,391 (1990) and 39,995 (1990). Japanese Kokai Application No. 160,681 (1989) discloses dye acceptance layers containing polyvinyl chloride-polyvinyl alcohol copolymers and Japanese Kokai Application Nos. 43,092 (1990); 95,891 (1990); and 108,591 (1990) disclose dye receptor layers containing a hydroxy-modified polyvinyl chloride resin and an isocyanate compound.

U.S. Pat. No. 4,990,485 discloses a heat-transfer image-receiving sheet containing a substrate and a dye-receiving layer that is composed of a graft copolymer having at least one grafted polysiloxane segment. The backbone of the copolymer chain may be vinyl chloride-containing copolymers including vinyl chloride-vinyl acetate and vinyl chloride-acrylic acid copolymers. At column 15, lines 9–17, the patent discloses the use of a vinyl chloride/n-butyl acrylate/glycidyl methacrylate/vinyl-modified polymethyl methacrylate copolymer which is grafted with stearyl alcohol.

Generally, polyvinyl chloride-based polymers are photolytically unstable, decomposing to form hydrogen chloride, which in turn degrades the image-forming dyes. This has necessitated the extensive use of UV stabilizers and compounds that neutralize hydrogen chloride.

Other materials have been used in such receptor elements as well. For example, U.S. Pat. No. 4,897,377 discloses a thermal transfer printing receiver element containing a supporting substrate coated on at least one surface with an amorphous polyester resin. Laid-open European Patent Application No. 133,012 (1985) discloses a heat transferable element having a substrate and an image-receiving layer thereon containing a resin having an ester, urethane, amide, urea, or highly polar linkage and a dye-releasing agent, such as a silicone oil, being present either in the image-receiving layer or as a release layer on at least part of the receptor layer. Laid-open European Patent Application No. 133,011 (1985) discloses a heat transferable element based on imaging layer materials containing first and second regions, composed, respectively, of: (1) a synthetic resin having a glass transition ($T_g$) temperature of from −100° C. to 20° C., and (2) a polar group; and a synthetic resin having a $T_g$ of 40° C. or above.

U.S. Pat. No. 4,914,078 discloses a receiver coat containing a dye-receptive material and a thermoset, amino-modified, silicone organic epoxide-based resin.

U.S. Pat. Nos. 4,626,256 and 4,927,666 disclose an image receiving sheet containing a dye permeable releasing agent containing a reaction hardened product of an amino-modified silicone and an epoxy-modified silicone.

U.S. Pat. No. 4,910,189 discloses a thermal transfer dyesheet containing a binder that further contains a thermoset silicone composition.

U.S. Pat. No. 4,931,423 discloses a thermal dye transfer receiving layer containing a resin and a silicone oil having a concentration gradient in the receiving layer.

What is needed in the industry is a thermal transfer imaging process which possesses the advantages of both thermal dye transfer and thermal mass transfer, but not their respective disadvantages and drawbacks.

SUMMARY OF THE INVENTION

By the present invention, it has now been discovered that both thermal dye transfer and thermal mass transfer can be effectively performed in one integrated process. The process involves the use of thermal transfer receptor elements, i.e., certain vinyl chloride-containing copolymers, with grafted releasing segments.

In one embodiment, the present invention provides a process for preparing an image comprising the steps of: (a) providing a thermal mass transfer donor element which comprises a substrate and a mass donor layer; (b) providing a thermal dye transfer donor element which comprises a substrate and a dye donor layer; (c) providing a thermal transfer receptor element comprising a substrate and a vinyl chloride-containing copolymer which has a $T_g$ between about 50° and 85° C.; a weight average molecular weight between about 10,000 and 100,000 g/mol; a hydroxyl equivalent weight between 500 and 7,000 g/equiv.; a sulfonate equivalent weight between about 9,000 and about 23,000 g/equiv.; and an epoxy equivalent weight between about 500 and about 7,000 g/equiv., wherein a reactive amino-modified silicone has been chemically bonded to the vinyl chloride-containing copolymer; (d) intimately contacting the thermal dye transfer donor element and the thermal transfer receptor element with simultaneous application of heat and pressure, thereby effecting transfer of a dye image from the thermal dye transfer donor element to the thermal transfer receptor element; and (e) intimately contacting the thermal mass transfer donor element with simultaneous application of heat and pressure, thereby effecting transfer of an image from the thermal mass transfer donor element to the thermal transfer receptor element. As used herein, the phrase "intimate contact" means that there are no air gaps or folds, etc., between the particular thermal transfer donor element and the thermal transfer receptor element.

In a preferred embodiment, the vinyl chloride-containing copolymer has a $T_g$ between about 55° and 65° C.; a weight average molecular weight between about 30,000 and 50,000 g/mol; a hydroxyl equivalent weight between 1,800 and 3,500 g/equiv.; a sulfonate equivalent weight between 11,000 and 19,500 g/equiv.; and an epoxy equivalent weight between about 1,000 and 6,000 g/equiv.

The inventive integrated thermal transfer imaging process unexpectedly does not possess the drawbacks and disadvantages associated with either thermal dye or thermal mass transfer. Instead, no unwanted mass transfer (or blocking of the dye donor element) occur during thermal dye transfer imaging, and in subsequent thermal mass transfer imaging, the thermal transfer element utilized in the present invention is capable of receiving and adhering the thermal mass transfer image.

The inventive process has the further advantage of producing a blended image with excellent continuous-tone full colors from the dye transfer imaging mode, highlighted with a bright false color image from the thermal mass transfer mode, such as a gold mark over the colored dye image.

Other aspects, advantages, and benefits of the present invention are apparent from the detailed description, examples, and claims.

DETAILED DESCRIPTION OF THE INVENTION

The thermal transfer image receptor elements used in the present invention comprise a supporting substrate having a dye receptive layer on at least one surface. The dye receptive layer is a vinyl chloride-containing copolymer which has a $T_g$ between about 50°-85° C. and more preferably between about 55°-65° C.; a weight average molecular weight between about 10,00'100,000 g/mol, and more preferably, between about 30,000-50,000 g/mol; a hydroxyl equivalent weight between about 500 and 7000 g/equiv., and more preferably between about 1,800-3,500 g/equiv.; a sulfonate equivalent weight between about 9,000-23,000 g/equiv., and more preferably, between about 11,000-19,500 g/equiv.; and an epoxy equivalent weight between about 500 and about 7000 g/equiv., and more preferably, between about 1,000-6,000 g/equiv., wherein a reactive amino-modified silicone has been chemically bonded to the vinyl chloride-containing copolymer.

Vinyl chloride-containing copolymers useful in the present invention are commercially available from Nippon Zeon Co., (Tokyo, Japan), under the tradenames "MR-110", "MR-113", and "MR-120". Alternatively, they may be prepared according to the methods disclosed in U.S. Pat. Nos. 4,707,411, 4,851,465, or 4,900,631, which are herein incorporated by reference.

Suitable comonomers for polymerization with vinyl chloride are likewise disclosed in the above cited patents. They include, but are not limited to, epoxy-containing copolymerizable monomers such as (meth)acrylic and vinyl ether monomers such as glycidyl methacrylate, glycidyl acrylate, glycidyl vinyl ether, etc. Sulfonated copolymerizable monomers include, but are not limited to, (meth)acrylic monomers such as ethyl (meth-)acrylate-2-sulfonate, vinyl sulfonic acid, allylsulfonic acid, 3-allyloxy-2-hydroxypropanesulfonic acid, styrene sulfonic acid, and metal and ammonium salts of these compounds. Hydroxyl group-containing copolymerizable monomers include, but are not limited to, hydroxylated (meth)acrylate such as 2-hydroxyethyl (meth)acrylate and 2-hydroxybutyl (meth)acrylate; alkanol esters of unsaturated dicarboxylic acids such as mono-2-hydroxypropyl maleate, di-2-hydroxypropyl maleate, mono-2-hydroxybutyl itaconate, etc.; olefinic alcohols such as 3-buten-1-ol, 5-hexen-1-ol, and 4-penten-1-ol, etc. Additional comonomers that may be copolymerized in minor amounts (not to exceed 5% by weight in total) include alkyl (meth)acrylate esters such as methyl (meth)acrylate, propyl (meth)acrylate, and the like; and vinyl esters such as vinyl acetate, vinyl propionate, vinyl butyrate and the like.

The dye image receiving layer must be compatible as a coating with a number of resins, since most commercially available dye donor elements are resin based. Since different manufacturers generally use different resin formulations in their donor elements, the dye receiving layer should have an affinity for several different resins. Because the transfer of dye from the dye donor element to the dye receptor element is essentially a contact process, it is important that there be intimate contact (e.g., no air gaps or folds) between the dye donor element and the dye receptor element at the moment of heating to effect imaging.

The proper selection of softening temperature (e.g., $T_g$) of the dye receiving layer is important in the preparation of the thermal dye transfer receptor element. Preferably, the dye receiving layer should soften at, or slightly below, the temperatures employed to transfer dye from the dye donor element. The softening point, however, must not allow the resin to become distorted, stretched, wrinkled, etc. In addition, the dye receptor element is preferably non-tacky and capable of being fed reliably into a thermal printer and is of sufficient durability that it will remain useful after handling, feeding, and removal from processing.

The thermal transfer receptor elements may be prepared by the process of introducing the various components for making the image receiving layer into suitable solvents (e.g., tetrahydrofuran (THF), methyl ethyl ketone (MEK), MEK/toluene blends, and mixtures thereof); mixing the resulting solutions (e.g., at room temperature); and then coating the resulting mixture onto a suitable substrate and drying the resultant coating, preferably at elevated temperatures. Suitable coating techniques include knife coating, roll coating, curtain coating, spin coating, extrusion die coating, gravure coating, etc. The image receiving layer is preferably free of any observable colorant (e.g., an optical density of less than 0.2 and preferably less than 0.1 absorbance units). The thickness of the dye receiving layer is from about 0.001 mm to 0.1 mm and preferably from about 0.005 mm to 0.010 mm.

In the present invention a reactive amino-modified silicone is chemically bonded to the vinyl chloride-containing copolymer. Reactive silicone amino groups may be attached either at an end of the silicone segment; along the backbone, or both, and are generally attached via an organic group (e.g., alkyl or aryl) that connects the amino group to a silicon atom in the silicone backbone. The amino groups may be primary or secondary, but tertiary amino groups are not useful in the present invention. The amino group equivalent weight of the amino-modified silicone is preferably about 100 to 2,000 g/equiv. and more preferably about 300 to 1,100 g/equiv. Primary amino-modified silicones are the most reactive and are most preferred.

Such amino-modified silicones are commercially available, such as those manufactured by Shin-Etsu Chemical Co., Ltd., (Tokyo, Japan), under the tradenames "X-22-161AS", "X-22-161A", "X-22-161B", "X-22-161C", "KF-393", "KF-859", "KF-861", "KF-867", "KF-867", "KF-869", "KF-880", "KF-8002", "KF-8004", "KF-8005", "KF-858", "KF-864", "KF-865", "KF-868", and "KF-8003".

The amino-modified silicone oil and the vinyl chloride-containing copolymer are generally combined in a solvent where spontaneous reaction occurs between the amino-modified silicone and epoxy groups of the vinyl chloride-containing copolymer. While not generally required, a catalyst for the process may be added. The reaction is normally carried out at room temperature, but may be accelerated if necessary by addition of a catalyst or by heating.

Suitable substrate materials may be any flexible material to which an image receptive layer may be adhered. Suitable substrates may be smooth or rough, transparent or opaque, and continuous or elementlike. They may be porous or essentially non-porous. Preferred backings are white-filled or transparent polyethylene terephthalate or opaque paper. Non-limiting examples of materials that are suitable for use as a substrate include polyesters (especially polyethylene terephthalate and polyethylene naphthalate); polysulfones; polystyrenes; polycarbonates; polyimides; polyamides; cellulose esters (especially cellulose acetate, and cellulose butyrate); polyvinyl chlorides and derivatives thereof; polyethylenes; polypropylenes; etc. The substrate may also be reflective such as a baryta-coated paper, an ivory paper, a condenser paper, or synthetic paper. The substrate may have antistatic and/or antistick layers applied to the side of the substrate opposite the dye receiving layer. The substrate generally has a thickness of from about 0.05 mm to 5 mm and preferably, from about 0.05 mm to 1 mm.

By "non-porous" it is meant that ink, paints, and other liquid coloring media will not readily flow through the substrate (e.g., less than 0.05 ml per second at 7 torr applied vacuum and preferably, less than 0.02 ml per second at 7 torr applied vacuum). The lack of significant porosity prevents absorption of the heated image receiving layer into the substrate.

The term "element" in referring to receptor elements, thermal dye transfer donor elements, and thermal mass transfer donor elements means cut coated stock, a continuous coated ribbon, or a patch coated ribbon.

The thermal transfer image receptor elements used in the present invention are used in combination with at least one thermal transfer dye donor element wherein a dye image is transferred from the dye donor element to the receptor element by the application of heat. The dye donor layer is placed in contact with the dye receiving layer of the receptor element and selectively heated according to a pattern of information signals whereby the dyes are transferred from the donor element to the receptor element. A pattern is formed thereon in a shape and density according to the intensity of heat applied to the donor element. The heating source may be an electrical resistive element, a laser (preferably an infrared laser diode), an infrared flash, a heated pen, or the like. The quality of the resulting dye image can be improved by readily adjusting the size of the heat source that is used to supply the heat energy, the contact place of the dye donor element and the dye receptor element, and the heat energy. The applied heat energy is controlled to give light and dark gradation of the image and for the efficient diffusion of the dye from the donor element to ensure continuous gradation of the image as in a photograph. Thus, by using in combination with a dye donor element, the image receptor element of the invention can be utilized in the print preparation of a photograph by printing, facsimile, or magnetic recording systems wherein various printers of thermal printing systems are used, or print preparation for a television picture, or cathode ray tube picture by operation of a computer, or a graphic pattern or fixed image for suitable means such as a video camera, and in the production of progressive patterns from an original by an electronic scanner that is used in photomechanical processes of printing.

Preferably, the thermal dye transfer step is conducted at an interfacial temperature in the range of about 40° to 280° C., and more preferably in the range of about 50° to 200° C. Preferably, the pressure is in the range of about 5 to 50 psi and more preferably, in the range of about 10 to 30 psi.

Suitable thermal dye transfer donor elements for use in the present invention are well known in the thermal imaging art. In a preferred embodiment, the donor elements are those of the type described in U.S. Pat. No. 4,853,365, which is herein incorporated by reference.

Following completion of thermal dye transfer the image receptor elements of the present invention are used in combination with at least one thermal mass transfer donor element.

Suitable thermal mass transfer donor elements for use in the present invention are well known in the thermal imaging art. Typical examples of such thermal mass transfer donor elements are disclosed in U.S. Pat. No. 4,822,643, herein incorporated by reference. In a preferred embodiment, the thermal mass transfer donor element comprises a substrate coated thereon with a colorant contained within a binder that is also transferred in the process as disclosed, for example, in U.S. Pat. Nos. 4,839,224 and U.S. Pat. No. 4,822,643, which are incorporated herein by reference. In another preferred embodiment, the colorant may be present in a binderless construction such as disclosed in U.S. Pat. No. 4,985,321 and Assignee's copending U.S. application Ser. Nos. 07/776,602 and 07/775,782, which are herein incorporated by reference.

In the thermal mass transfer imaging step a pattern is formed on the image receptor element in a shape and dot size according to the intensity of heat applied to the thermal mass transfer donor element. The heating source for the thermal mass transfer step may be an electrical resistive element, a laser (preferably an infrared laser diode), an infrared flash, a heated pen, or the like. Preferably, the heat source for the thermal dye transfer and thermal mass transfer steps are the same.

Preferably, the thermal mass transfer step is conducted at an interfacial temperature in the range of about 40° to 200° C., and more preferably in the range of about 50° to 150° C. Preferably, the pressure is in the range of about 5 to 50 psi and more preferably, in the range of about 10 to 30 psi.

Other additives and modifying agents that may be added to the dye receiving layer include UV stabilizers, heat stabilizers, suitable plasticizers, surfactants, release agents, etc., used in the dye receptor element of the present invention.

The following non-limiting examples further illustrate the present invention.

EXAMPLES

Materials used in the following examples were available from standard commercial sources such as Aldrich Chemical Co., Milwaukee, Wis., unless otherwise specified.

The term "PVC" refers to polyvinyl chloride.

The term "PET" refers to polyethylene terephthalate.

The term "Mayer bar" refers to a wire wound rod such as that sold by R & D Specialties, Webster, N.Y.

EXAMPLE 1

This example illustrates the reactivity of SHEV resin (sulfonated/hydroxy/epoxy/vinyl chloride-containing copolymer) and amino-modified silicone oil in solution at room temperature. Their reactivity is indicated by increase in viscosity with time.

A solution containing 7.46 wt % MR-120 TM vinyl chloride-containing copolymer resin (hydroxyl equivalent weight of 1,890 g/equiv.; a sulfonate equivalent weight of 19,200 g/equiv.; an epoxy equivalent weight of 5,400 g/equiv., $T_g$=65° C., $M_w$=30,000 obtained from Nippon Zeon Co., Tokyo, Japan), 7.46 wt % UCAR VYNS-3 TM vinyl chloride/vinyl acetate copolymer, 9:1 by weight, $M_n$=44,000, Union Carbide, Danbury, Conn.), and 0.60 wt % KF-393 TM amino-modified silicone fluid (amino equivalent weight 360 g/equiv., Shin-Etsu Chemical Co., Ltd., Tokyo, Japan) in MEK (methyl ethyl ketone) was freshly prepared.

The original viscosity of the solution and subsequent change in viscosity with time were measured with a Brookfield Digital Viscometer, Model LVTDCP at 25° C. The results showed that the viscosity of the solution was 65.1 cps originally, followed by an increase in viscosity with time of 67.8 cps at one hour, 69.4 cps at 2 hours, 77.2 cps at 3 hours, 83.2 cps at 6 hours, and 83.3 cps at 22 hours after the solution was prepared. The increase in viscosity apparently was due to the reaction between the multi-functional SHEV resin and amino-modified silicone oil. Most of the reaction appeared to take place in the first six hours.

EXAMPLE 2

This example demonstrates the utility of a SHEV resin reacted in situ with an amino-modified silicone fluid as a dye receiver.

Two dye receptor elements were prepared by hand-spread coating a solution containing 14.89 wt % MR-120 TM (a SHEV as used in Example 1) and 0.76 wt % KF-393 TM (as used in Example 1) in MEK onto a 4-mil polyethylene terephthalate film (3M Company, St. Paul, Minn.) to a wet film thickness of 3 mils and drying the same at 100° C. in an oven for one minute.

One of the resulting receptors was immediately tested through an A-3 size Mitsubishi Thermal Printer, Model X1012M (Mitsubishi Electric Co., Tokyo, Japan) for dye receptivity and anti-mass transfer property during the dye transfer imaging step. A four color (yellow, magenta, cyan, and black) ribbon (PE-433 3M Desktop Color Proofing Ribbon, I.D. No. 77-9803-7692-3, 3M Company, St. Paul, Minn.) was used to test the receptor using the printer's built-in self test pattern. The receptor went through the printer smoothly and produced a full-color image including five 7/16"×10" color bars with continuous gradation. The density of these color images was measured by a Gretag SPM-100 densitometer (Gretag Limited, Regensdorf, Switzerland). The ROD (reflectance optical density) was 0.55 for yellow, 0.78 for magenta, 0.89 for cyan, and 1.17 for four-color black. There was no thermal mass transfer occurring except for the four-color overlaid black (i.e., the black color obtained by overlaying yellow, magenta, cyan and black).

Two days later, the other unused receptor was tested through the printer in the same way. No thermal mass transfer occurred at all this time, indicating better release (or anti-mass transfer property) with aging. Apparently, during this aging period, more complete reaction between MR-120 TM and KF-393 TM has taken place, thus resulting in a better release.

EXAMPLE 3

This example shows feasibility of including other dye receiving resins such as UCAR VYNS-3 TM (as used in Example 1) in the SHEV/amino-modified silicone system as a dye image receptor.

Two different receptors were prepared in the same way as in Example 2, except for using a different coating solution. Here, the solution containing 7.47 wt % MR-120 TM (see Example 1), 7.47 wt % UCAR VYNS-3 TM, and 0.49 wt % KF-393 TM (see Example 2) in MEK was used. The resulting receptor was aged at room temperature for one day and then tested for dye receptivity and anti-mass transfer property in the same manner as in Example 2.

The result indicated that the dye receptivity of this receptor was very good, yielding an image with a ROD of 0.67 for yellow, 0.88 for magenta, 1.09 for cyan, and 0.93 for single black. The image was clean and free of any mass-transfer during the dye imaging step.

EXAMPLE 4

This example illustrates the feasibility of the receptor element utilized in this invention in both thermal dye transfer and thermal mass transfer processes.

A 200-ft roll of transparent thermal transfer image receptor material was prepared by slot-coating a solution containing 4.8 wt % MR-120 TM, 4.8 wt % UCAR VYNS-3 TM, and 0.38 wt % KF-393 TM in MEK on a latex primed polyester film (4 mil thick, 3M) at 50 feet per minutes and drying through a 50 feet oven at 65° to 93° C. The dry coating weight was 5 g/m$^2$.

The receptor was stored at room temperature for a week. It was then tested for dye receptivity and anti-mass transfer property in the same manner as Example 2. A clean and sharp full color image was produced and there was no thermal mass transfer problem in the dye transfer imaging process. The image was very dense, showing color density (ROD) of 0.89, 1.37, 1.41, and 1.19 for yellow, magenta, cyan, and single black, respectively.

The receptor was further tested for its suitability for both thermal dye transfer and thermal mass transfer. A Mitsubishi Full Color Printer, Model S-340-10, was used. By using the same four color dye donor ribbon as used in Example 2, the receptor was first imaged through the printer in the dye transfer mode to give a continuous tone full color dye image. The resulting image was clean and free of any mass-transfer problem in the thermal dye transfer step.

Subsequently, the receptor having this dye image already transferred was highlighted with a metallic mass transfer image through the same printer using a thermal mass transfer mode (yellow separation for a black image). The metallic ribbon used had a 300 angstrom vapor coating of aluminum and a 4.5 μm polyester film that had been precoated over 80% of the film surface with a boehmite layer. The dye image can be highlighted with a symbol, text, or picture. In this experiment, a bright, solid gold picture of a "Reindeer" was vividly printed on the same receptor.

Reasonable variations and modifications are possible from the foregoing disclosure without departing from either the spirit or scope of the present invention as defined by the claims.

What is claimed is:

1. A process for preparing an image comprising the steps of: (a) providing a thermal mass transfer donor element which comprises a substrate and a mass donor layer; (b) providing a thermal dye transfer donor element which comprises a substrate and a dye donor layer; (c) providing a thermal transfer receptor element comprising a substrate and a vinyl chloride-containing copolymer which has a $T_g$ between about 50° and 85° C.; a weight average molecular weight between about 10,000 and 100,000 g/mol; a hydroxyl equivalent weight between 500 and 7,000 b/equiv.; a sulfonate equivalent weight between about 9,000 and about 23,000 g/equiv.; and an epoxy equivalent weight between about 500 and about 7,000 g/equiv., wherein a reactive amino-modified silicone has been chemically bonded to said vinyl chloride-containing copolymer; (d) intimately contacting said thermal dye transfer donor element and said thermal transfer receptor element with simultaneous application of heat and pressure, thereby effecting transfer of a dye image from said thermal dye transfer donor element to said thermal transfer receptor element; and (e) intimately contacting said thermal mass transfer donor element and said thermal transfer receptor element with simultaneous application of heat and pressure, thereby effecting transfer of an image from said thermal mass transfer donor element to said thermal transfer receptor element.

2. The process according to claim 1 wherein said vinyl chloride-containing copolymer has a $T_g$ between about 55°-65° C.

3. The process according to claim 1 wherein said vinyl chloride-containing copolymer has a weight average molecular weight between about 30,000-50,000 g/mol.

4. The process according to claim 1 wherein said vinyl chloride-containing copolymer has a hydroxyl equivalent weight between about 1,800-3,500 g/equiv.

5. The process according to claim 1 wherein said vinyl chloride-containing copolymer has an epoxy equivalent weight between about 1,000 to 6,000 g/equiv.

6. The process according to claim 1 wherein said vinyl chloride-containing copolymer has a sulfonate equivalent weight between about 11,000-19,500 g/equiv.

7. The process according to claim 1 wherein said vinyl chloride-containing copolymer is a vinyl chloride-vinyl acetate copolymer.

8. The process according to claim 1 wherein the amino group equivalent weight of said amino-modified silicone is about 100 to 2,000 g/equiv.

9. The process according to claim 1 wherein the amino group equivalent weight of said amino-modified silicone is about 300 to 1,100 g/equiv.

10. The process according to claim 1 wherein step (d) is conducted at a temperature in the range of about 40° to 280° C. and a pressure in the range of about 5 to 50 psi.

11. The process according to claim 1 wherein step (e) is conducted at a temperature in the range of about 40° to 200° C. and a pressure in the range of about 5 to 50 psi.

* * * * *